United States Patent [19]

Smith

[11] 4,103,503

[45] Aug. 1, 1978

[54] DRILLING SUBSTRUCTURE TRANSFER SYSTEM

[75] Inventor: Marvin L. Smith, Houston, Tex.

[73] Assignee: Dixilyn International, Inc., Houston, Tex.

[21] Appl. No.: 753,092

[22] Filed: Dec. 21, 1976

[51] Int. Cl.[2] ..... E02D 25/00

[52] U.S. Cl. ..... 61/97; 61/90; 61/91

[58] Field of Search ..... 61/86–94, 61/97–102; 114/258, 264; 214/38 BA

[56] References Cited

U.S. PATENT DOCUMENTS

| | | | |
|---|---|---|---|
| 1,894,950 | 1/1933 | Fitch | 214/38 BA |
| 2,489,869 | 11/1949 | Dunn | 214/38 BA |
| 2,644,971 | 7/1953 | Rowe | 214/38 BA X |
| 2,934,905 | 5/1960 | Woolslayer et al. | 61/97 |
| 2,959,015 | 11/1960 | Beck | 61/97 |
| 2,997,852 | 8/1961 | Suderow | 61/93 |
| 3,011,318 | 12/1961 | Ashton | 61/97 |
| 3,033,525 | 5/1962 | Johnson | 61/93 X |
| 3,150,787 | 9/1964 | Patrignani | 214/38 BA X |
| 3,448,511 | 6/1969 | Suter | 61/94 X |
| 3,931,778 | 1/1976 | Miller et al. | 114/258 X |
| 3,952,887 | 4/1976 | Lutz | 214/38 BA X |

*Primary Examiner*—Dennis L. Taylor

*Attorney, Agent, or Firm*—C. Emmett Pugh & Associates

[57] ABSTRACT

An apparatus and method for providing a drilling rig substructure on a fixed platform which includes the transfer of the drilling rig substructure from a movable jack-up type rig to an adjacent, fixed oil platform. The method provided utilizes a conventional type jack-up rig which includes a barge mounted telescopically on a plurality of structural support legs. A substructure, containing the entire apparatus for drilling or reworking an oil or gas well, connected to an associated bridge and skid mat, are connectably housed on the barge portion of the jack-up rig. The barge is elevated to the approximate level of the fixed platform to which the drilling apparatus is to be transferred. The substructure, bridge and skid mat are slid from the barge towards the surface of the fixed platform to a degree which leaves the substructure and associated drilling apparatus on the barge portion of the jack-up rig. The substructure is disconnected from the skid mat and bridge, and a second elevational increase elevates the substructure to a level where it can be slid from the barge across the bridge (connected now to the barge portion of the jack-up rig) onto the skid mat, now located on the fixed platform.

The apparatus of the present invention includes a substructure capable of housing and supporting a typical oil drilling apparatus, a connecting bridge for spanning the gap between the jack-up rig and the fixed platform during the skidding operation, and a structural skid mat. The mat is so dimensioned that the substructure and associated drilling equipment can be adjusted as needed within allowable tolerances to rework or drill new wells on existing fixed platforms which initially are without the necessary drilling facilities.

12 Claims, 7 Drawing Figures

DRILLING SUBSTRUCTURE TRANSFER SYSTEM

BACKGROUND OF THE INVENTION

1. Field of the Invention

The present invention relates to the drilling and remedial operations associated with offshore oil or gas wells, and the like. More particularly, the present invention relates to a method and apparatus for the transfer of a drilling apparatus from a movable vessel such as a jack-up rig to a permanent fixed offshore structure, where the transfer is effected by raising the movable vessel and contained drilling apparatus to the appropriate level adjacent the fixed structure and skidding the drilling apparatus onto the permanent fixed platform structure.

2. Prior Art

In the drilling of offshore oil wells, a fixed platform is constructed above a promising field, whereafter several wells may be drilled from the platform for the eventual production of oil or natural gas.

In an economic decision, the drilling portion of the platform is removed after the necessary wells have been drilled. When the drilling structure is removed, the platform becomes merely a production platform, no longer having "drilling" capabilities. After a time, the situation can develop where a drilling structure is needed on the platform once again. Sometimes additional wells may be desired in a field which was not productive economically in years previous. A raise in the price of oil can change the economic situation, making prior fields which were not economically feasible now attractive to the owner or lessee. This can bring about the need for drilling new wells off of an existing fixed platform. Additionally, existing wells may require remedial operations which necessitate the use of a drilling type structure. In either case, it is a costly and time consuming problem to replace the drilling structure once again on the fixed platform after it was previously removed.

The present method for placing or replacing a drilling apparatus and its associated substructure onto a platform is by the use of an enormous derrick mounted on a conventional type barge. This vessel is known in the oil and gas offshore industry as a "derrick barge". Several derrick barges are operating in this country, and the cost is estimated to be about $50,000.00 a day. Additionally, the time to install the oil drilling apparatus and its associated substructure back onto the fixed platform is usually a minimum of 4 days. Not only is there the cost of the rental on a derrick barge for 4 days, but this method ties up 4 days of time which normally would be available to drill for oil, which revenues are additionally lost.

GENERAL DISCUSSION OF THE PRESENT INVENTION

The present invention solves the economic and time consuming problems of the prior art by providing a method and apparatus for the placement of a drilling apparatus and associated substructure onto the operating deck of a fixed platform in offshore waters by the use of a conventional jack-up rig. It should be understood in this application that the term "jack-up rig" refers to any of several conventional type marine vessels which contain a barge portion which is floating or floatable, and has a plurality of telescoping legs which can be lowered into a position on the ocean floor, and the barge thereafter lifted high above the water surface utilizing power on the barge to elevate the barge portion of the jack-up rig upwardly on its telescoping legs.

In the present invention, the drilling structure and its associated substructure are contained on the deck portion of the jack-up rig together with a bridge structure and a skid mat. To begin the operation, the jack-up rig is located proximately to the fixed platform on which it is desired to place the drilling apparatus. The barge portion of the rig is elevated to the approximately level of the deck of the fixed platform. The drilling apparatus, placed on its associated substructure, is connected the bridge and skid mat in series. The drilling apparatus on the substructure, the connected bridge and skid mat are at once skidded across the deck of the barge toward the fixed platform to a position where the skid mat is on the fixed platform, the bridge connects the skid mat to the substructure over open water and the substructure and its contained drilling apparatus remain on the barge portion of the jack-up rig. A second elevation of the barge is made after the substructure and bridge are disconnected. The second elevational change aligns the surface of the skid mat, the bridge, and the deck of the jack-up rig. The bridge then is structurally connected to the side of the barge portion of the jack-up rig.

In the final step, the substructure is skidded across the bridge, now connected to the barge and skid mat. In its final position on top the skid mat portion of the present invention, the drilling apparatus and its associated substructure can be adjusted within tolerable limits as needed for the drilling or reworking of oil or gas wells, by adjustably skidding the substructure as needed on the skid mat.

The use of a jack-up rig to transfer a drilling apparatus and its supporting substructure to a fixed platform affords a substantial savings in time and cost. The operation consumes approximately two days of time as opposed to four with a derrick barge, and the operating cost on a per diem basis is less than one half the cost for a derrick barge.

DETAILED DESCRIPTION OF THE PREFERRED EMBODIMENT

Figure 1:
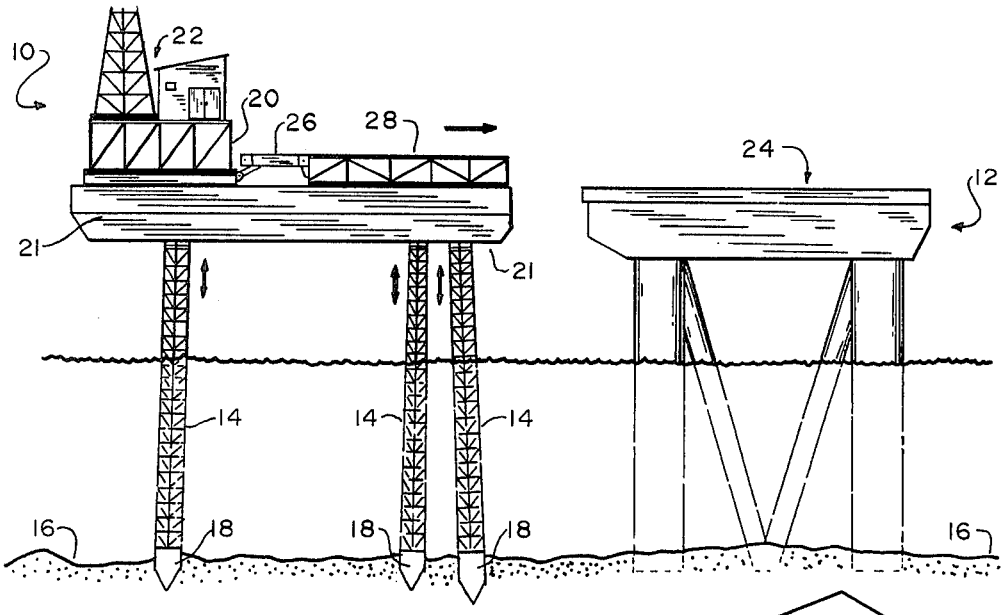
FIG. 1 is an elevational view of a conventional jack-up rig having the apparatus of the present invention on its deck portion, the jack-up rig being positioned proximate to a fixed offshore oil platform.

FIG. 1 illustrates an overall view of the apparatus of the present invention. FIG. 1 shows a convention type jack-up rig designated generally by the numeral 10 in close proximity to a fixed permanent offshore platform designated by the numeral 12. Jack-up rig 10 has a plurality of telescopic legs 14 which can be extended to the ocean floor 16 where the lower most tips or cans 18 bite into the ocean floor 16 and form a structural base for the jack-up rig and its contained equipment. Jack-up rig 10 has a barge portion 21 which rides up and down legs 14.

(See arrows, FIG. 1.) Examples of typical jack-up rigs can be found in the September issue of *Ocean Industry*, in the article entitled "1976–77 Director of Marine Drilling Rigs", at page 39. A specific example of jack-up rigs which could be used with the present invention are illustrated on page 76 of the September *Ocean Industry*, where the "Dixilyn Two-Sixty" and the "Dixilyn Three-Seventy" are shown.

In the method and apparatus of the present invention, jack-up rig 10 contains a substruture 20 on which there is contained a conventional type oil drilling apparatus 22. For the purposes of this application, it is understood that drilling apparatus 22 can include any and all pumps, piping, derrick, superstructure, quarters and the like associated equipment necessary to perform drilling operations, reworking operations and any other associated remedial operations associated with the drilling or reworking of oil or gas wells. FIG. 1 illustrates the position of the substructure prior to its transfer to the deck portion 24 of a fixed offshore platform 12. The transfer of drilling apparatus 22 to offshore platform 24 is a necessary operation so that either new wells can be drilled under platform 12 or existing wells may be repaired, reworked or other remedial operations. For the transfer of drilling apparatus 22 to the deck 24 of platform 12, there is provided a structural bridge 26 and a skid mat 28.

Figure 2:
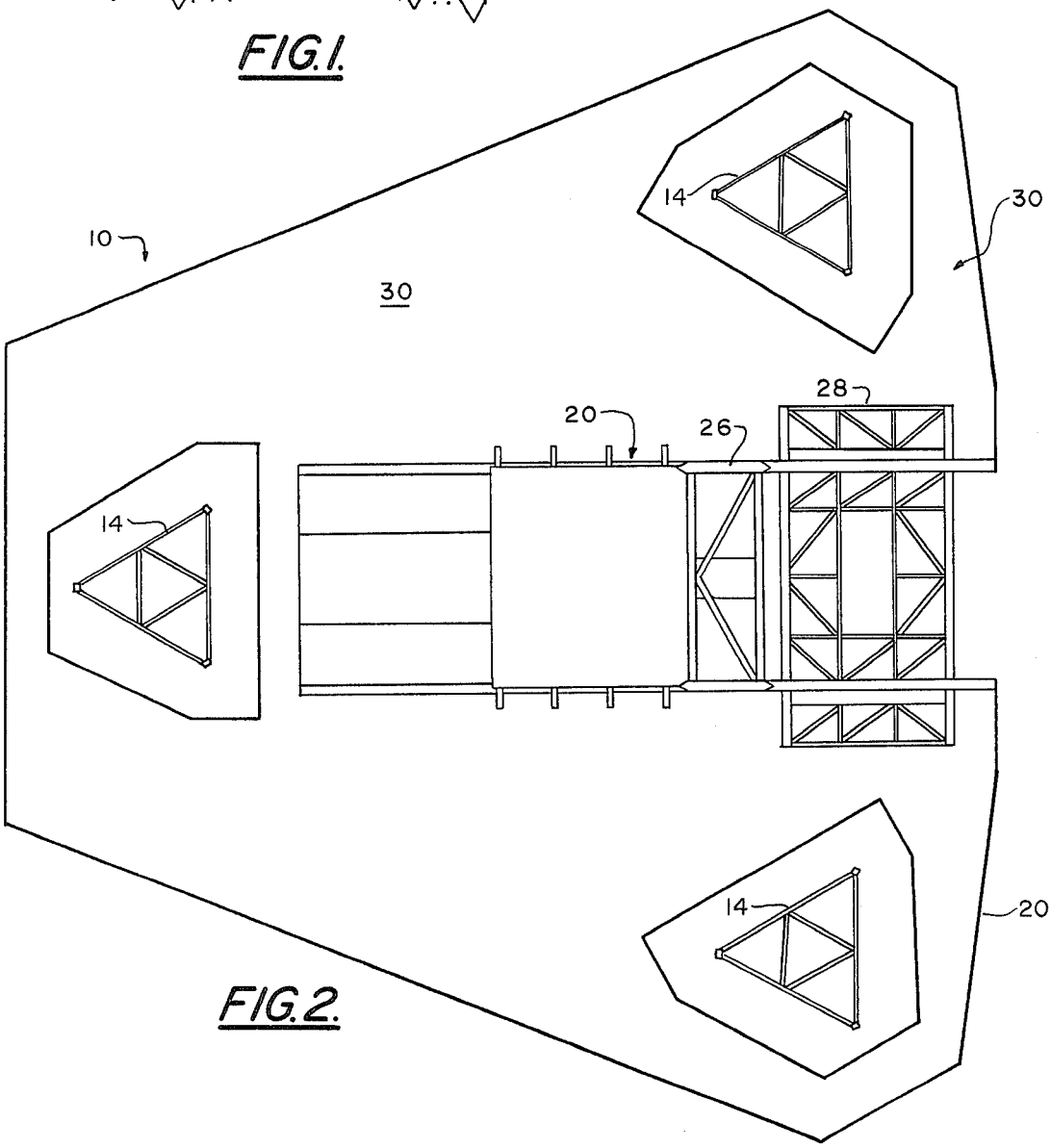
FIG. 2 is a plan view of the skid mat, bridge, and oil drilling apparatus substructure positioned on the deck of the barge portion of a conventional jack-up rig.
Figure 3A:
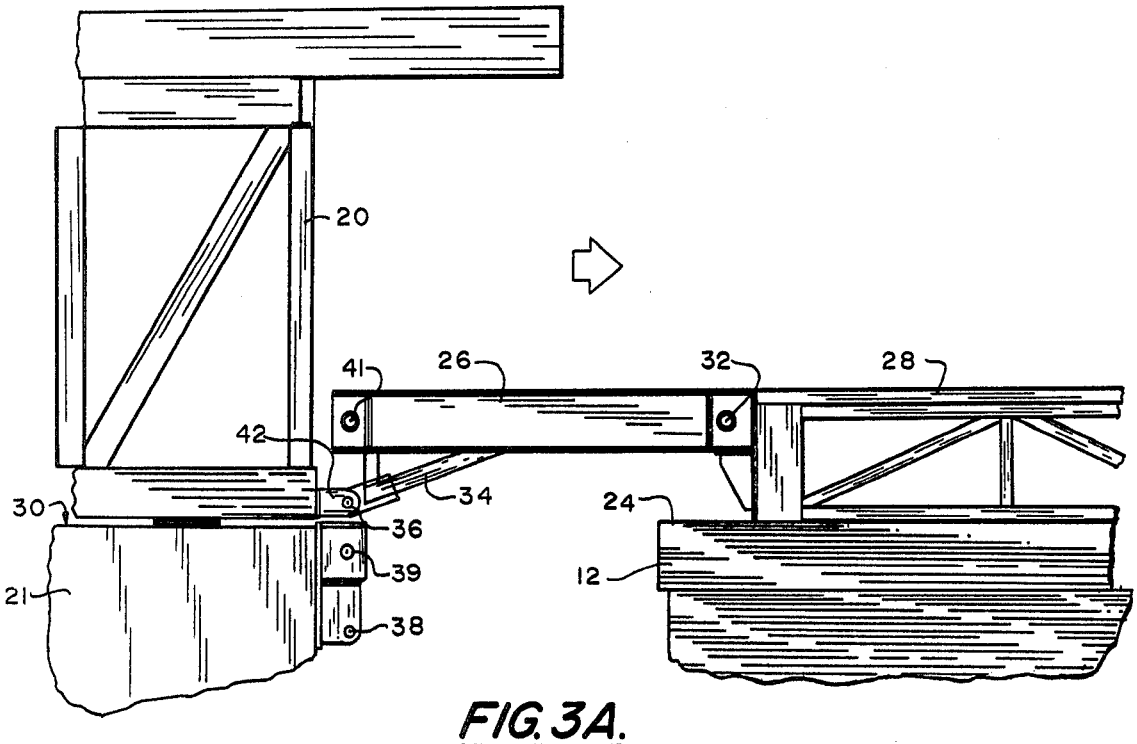
FIGS. 3A – 3D illustrate the sequential steps of the method of transferring a drilling apparatus from a conventional jack-up rig onto the deck of a fixed offshore oil platform.
Figure 3B:
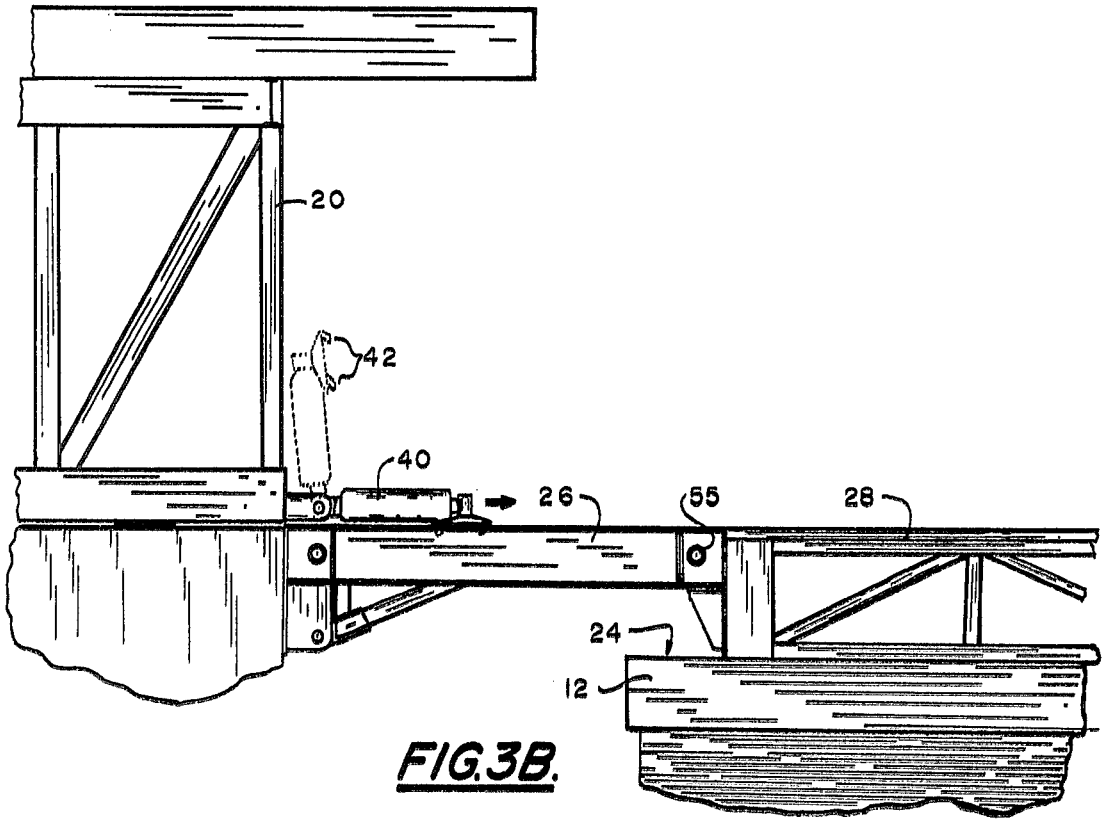
Figure 3C:
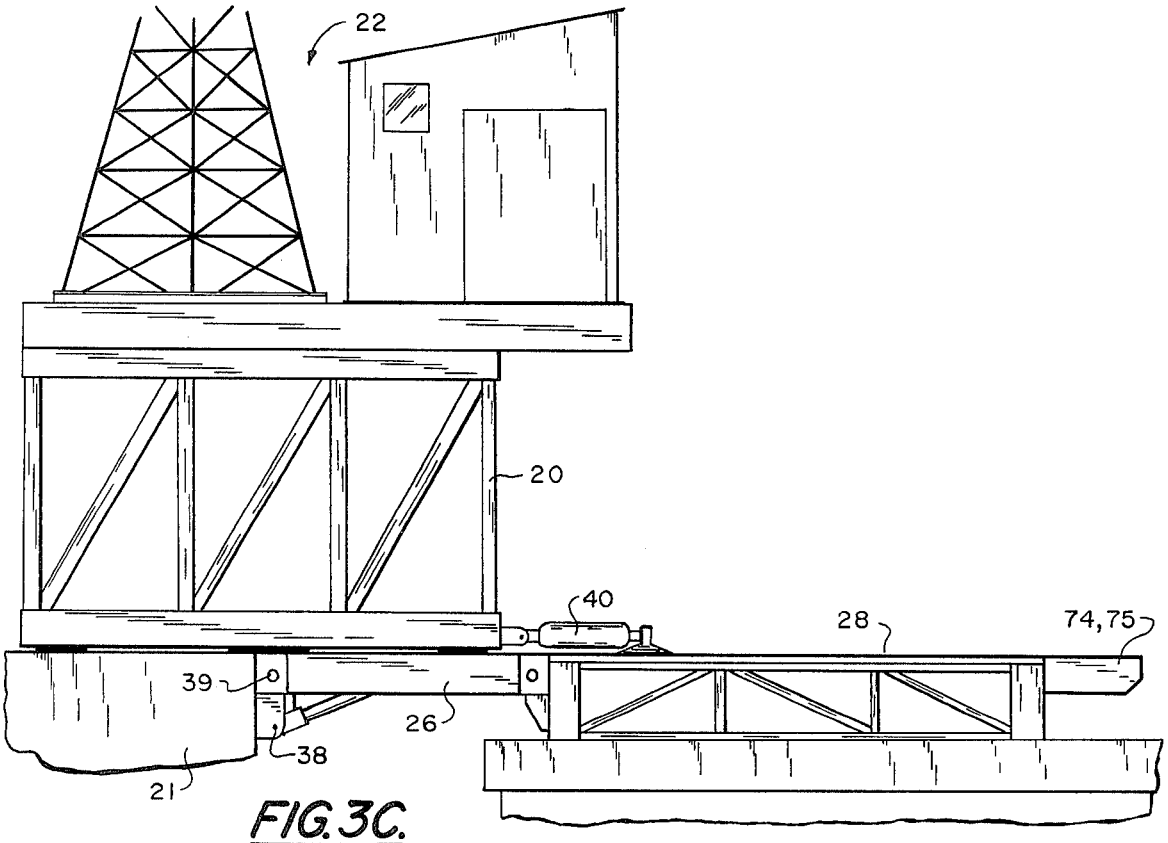
Figure 3D:
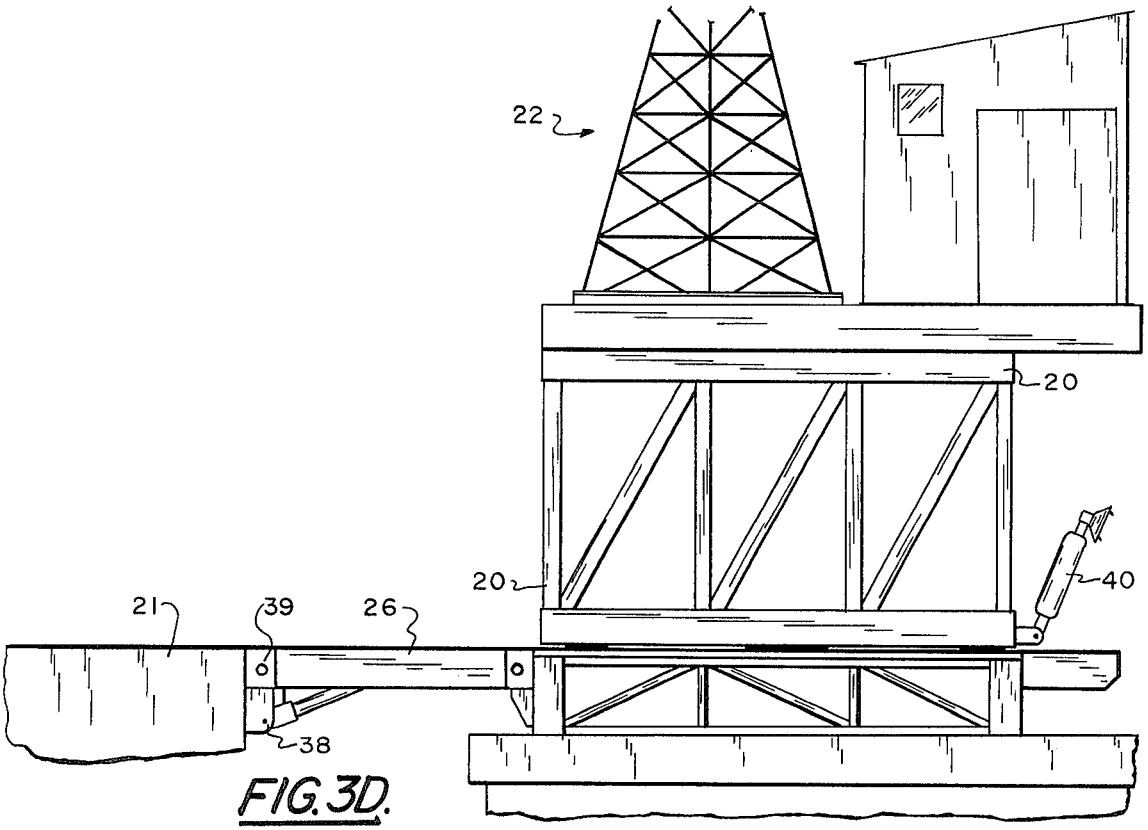

FIGS. 2 – 3D illustrate the sequential steps of transferring drilling apparatus 22 on substructure 20 from the deck portion 30 of jack-up rig 10 to the deck 24 of platform 12. FIG. 2 especially illustrates the initial position of the substructure 20 (on which the derrick and other drilling apparatus are located), the bridge 26 (which will span the open space between the jack-up rig 10 and platform 12 during the transfer operation), and skid mat 28 (which will allow final adjustment as needed of drilling apparatus 22 after placement on platform 12). FIG. 3A shows a second sequential step of the method of the present invention, where the skid mat, bridge and substructure have been skidded (utilizing available power e.g. winches) across the deck 30 of jack-up rig 10, until skid mat 28 reaches the deck 24 of fixed platform 12.

The respective connections between substructure 20, bridge 26, and skid mat 28 are also illustrated in FIG. 3A, as are the initial elevational positions of the deck 30 of barge 20 and the deck 24 of platform 12. It can be seen by an inspection of FIG. 3A that the decks are at a relatively identical elevation, with the bottom of substructure 20 resting on the deck 30 of barge 21. Likewise, as illustrated in FIG. 3A, the bottom portion of skid mat 28 is resting on the deck 24 of fixed platform 12. The connection between skid mat 28 and bridge 26 is a pinned connection designated by the numeral 32 in FIG. 3A. Bridge 26 is provided with a lower extending strut 34 which is initially pinned at connection 36 to substructure 20.

Although FIG. 3A illustrates the second sequential step of transferring drilling apparatus 22 to fixed platform 12, it should be understood the method of operation for transferring skid mat 28, bridge 26 and substructure 20 to this position. Initially skid mat 28 rested entirely on barge 21 (see FIGS. 1 and 2). Any conventional power source is utilized to pull the entire connected combination of skid mat 28, bridge 26 and substructure 20 to the position shown in FIG. 3A. It can be seen by one skilled in the art that the placement of jack-up rig 10 must be close enough to fixed platform 12 so that skid mat 28 can easily span the distance between rig 10 and platform 12 without falling into the depth between them. In the present invention, an exemplary allowable distance between platform 12 and rig 10 is 15 feet. Substructure 20, bridge 26, and skid mat 28 are pushed in this manner until the pinned connection 36 lines up vertically with mounting holes 38, 39. It is preferable in fact to have pin connection 36 go beyond the outer most edge of barge 21 by a small dimension, for example, one-quarter inch. At this point, pin connection 36 is disconnected and jack-up rig 10 is further elevated until connections 38 and 39 can be mated with mounting holes 41 of bridge 26 and mounting hole 42 of strut 34. This second connection can best be seen by FIG. 3B. Fine adjustments as necessary to maintain this second connection can be achieved through the use of jack 40. Jack 40 engages slotted openings (see FIG. 4) in bridge 26.

Figure 4:
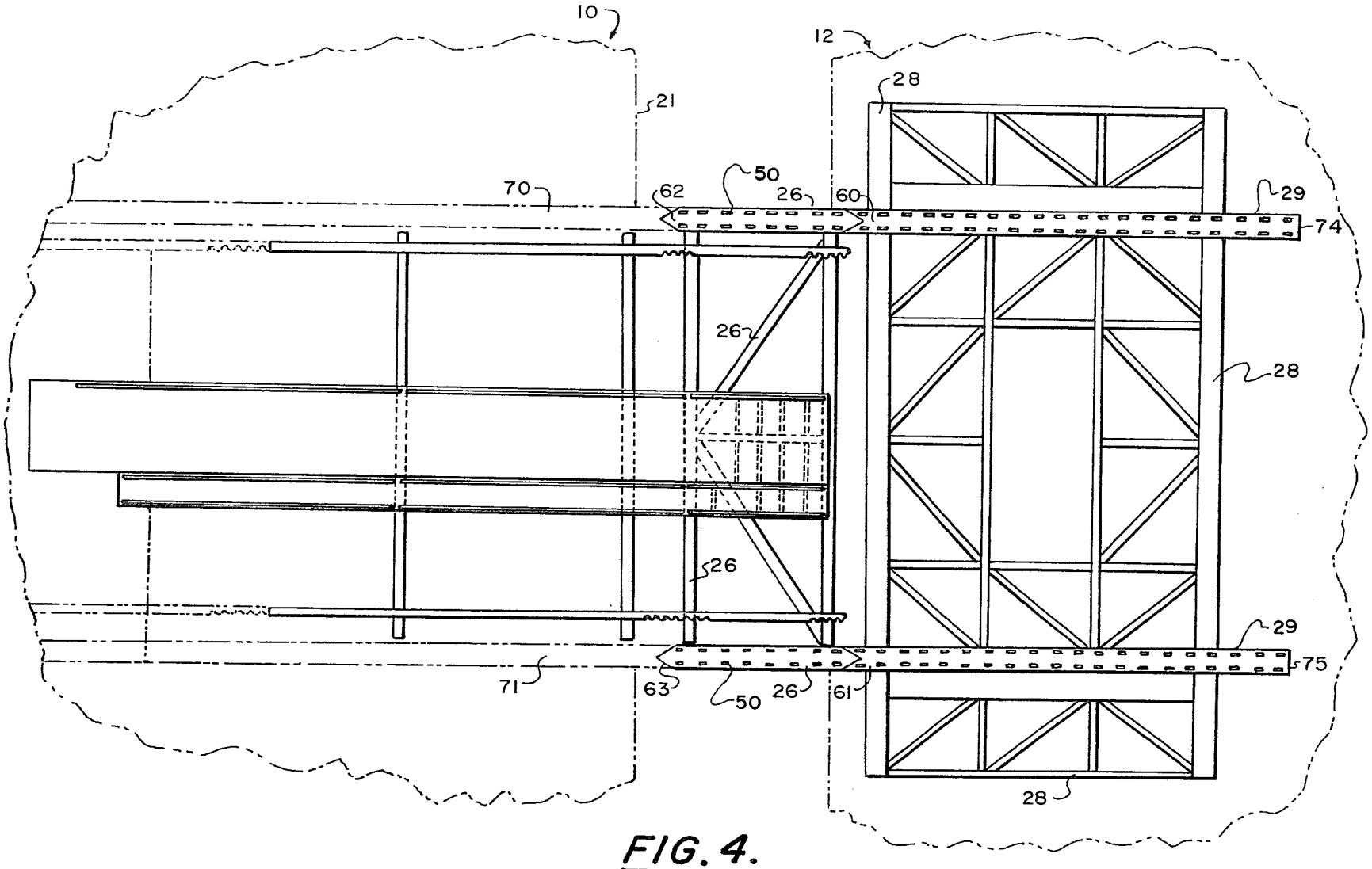
FIG. 4 is a plan view of the skid mat and bridge illustrating the connection between the barge portion of the jack-up rig and a fixed offshore platform.

When the connection as shown in FIG. 3B is achieved, jack 40 engages slots 50 in bridge 26 and in skid mat 28. Jack 40, as can be seen in FIG. 3B, is equipped at its outermost tip with hooks 42 which enable it to grasp and pull substructure 20 when hooks 42 are engaged in slots 50 (See FIG. 4) of bridge 26 and skid mat 28. FIG. 4 illustrates the orientation of skid mat 28 and bridge 26 (as connected to the barge portion 21 of jack-up rig 10) during the actual skidding operation. Skid mat 2B rests wholely on the deck 24 of fixed platform 12. Bridge 26 is structurally connected at one end portion to skid mat 28 at connection points 60, 61 in FIG. 4; and at its other end portion, bridge 26 is structurally connected at connection points 62, 63.

The upper surface 65 of bridge 26, the upper surface 29 of skid mat 28, and the upper surface 30 of jack-up rig 10 are at the same substantial elevation during the skidding of substructure 20 (and its contained and supported drilling apparatus 22) to fixed platform 12.

Skid plates 70, 71 on jack-up rig 10 can be provided to guide substructure 20 toward the skid beams 72, 73 of bridge 26, and the skid beams 74, 75 of skid mat 28.

When this connection is achieved, as is shown in FIGS. 3C and 3D, alternating extensions and contractions of jack 40 when hooks 42 are engaging slots 50, will skid substructure 20 and the drilling apparatus 22 thereon across bridge 26 onto skid mat 28 (see FIG. 3D). Skid mat 28 is so sized as to span the structural girder members of fixed platform 12. Adjustments linearly along skid mat 28 can be achieved using jacks 40 to engage the slots 50 of skid beams 74, 75. Rotational fine adjustments of skid mat 28 on platform girders 52 can be effected by winches or other conventional power sources.

Thus, it can be seen from the above that a drilling apparatus mounted on an associated substructure can be skidded from a conventional jack-up rig onto a fixed platform and thereafter adjusted as needed so that wells can be drilled or reworked or like operations as required for the drilling operation.

Although a particular detailed embodiment of the transfer apparatus and method has been described in the illustrations it should be understood that the invention is not restricted to the details of the preferred embodiment and many changes in design, configuration and dimensions are possible without departing from the scope of the invention.

What is claimed as invention is:

1. An apparatus for transferring an oil or gas drilling apparatus from a jack-up rig to a fixed platform which apparatus comprises:

a substructure capable of supporting a drilling apparatus;

b. a structural bridge connectable to said substructure;

c. a structural skid mat connectable to the opposite end portion of said structural bridge from the portion of said bridge connectable to said substructure, said substructure, said bridge, and said skid mat connectable in a manner which allows said substructure, said bridge and said skid mat to be skidded on the surface of the jack-up rig to a position placing said skid mat on the fixed platform, said substructure remaining on said jack-up rig; and;

d. connection means on said bridge for connecting said bridge to a side deck portion of the jack-up rig, the top portion of said bridge being substantially level with the top portions of said skid mat and said jack-up rig, said bridge and said skid mat when so connected being capable of supporting said substructure with a contained drilling apparatus thereon.

2. The apparatus as claimed in claim 1, wherein said substructure is additionally comprised of means for skidding said substructure along said jack-up rig, said bridge, and said skid mat.

3. The apparatus as claimed in claim 2, wherein said skidding means is at least one hydraulic jack attached to said substructure, said jack having hook means for gripping at least a portion of said bridge, and said skid mat.

4. The apparatus as described in claim 3 wherein said skid mat and said bridge are provided with upper slotted means for receivably connecting said jack to said slots at said hook means.

5. The apparatus as described in claim 4, wherein there is provided on the jack-up rig, means for connecting one end portion of said bridge to said jack-up rig, said connection positioning said bridge horizontally at an elevation substantially equal to that of the deck portion of said skid mat, the other end portion of said bridge connectable to said skid mat at a position which places the elevation of said bridge substantially equal to the other surface of said skid mat.

6. A method for placing an oil or gas drilling apparatus on a fixed offshore platform, comprising the steps of:

a. providing the drilling apparatus on a jack-up rig having one or more legs and a barge portion;

b. jacking down the legs until they engage water bottom, raising the barge portion out of the water, thereby supporting the jack-up rig firmly on the water bottom;

c. elevating the jack-up rig to a level substantially equal to the level of the fixed platform; and d. sliding the drilling apparatus from the jack-up rig to the fixed platform.

7. The method of claim 6, wherein there is further included between steps *b* and *c* the step of connecting a bridge between the jack-up rig and the fixed platform.

8. The method of providing an oil or gas drilling apparatus on a fixed offshore platform comprising the steps of:

a. providing a jack-up rig including a structure which comprises:

i. a rigid, moveable substructure for supporting the drilling apparatus, ii. a structural skid mat, and iii. a rigid, moveable structural bridge connectable at one end portion to said skid mat and at the other end portion to said substructure;

b. placing the substructure, skid mat, and bridge on a conventional type jack-up rig;

c. locating the jack-up rig proximately to the fixed platform;

d. connecting the bridge at one end portion to the substructure and its other end portion to the skid mat, the connection made so that the bottom surface elevation of the skid mat and substructure are substantially equal;

e. elevating the jack-up rig to an elevation where the surface of the jack-up rig is substantially at equal elevation to the furface of the fixed platform;

f. sliding the skid mat and bridge from the jack-up rig to the fixed platform a distance which aligns the end portion of the bridge connected to the substructure with the edge of the jack-up rig nearest the fixed platform;

g. parting the connection between the substructure and the bridge;

h. elevating the jack-up rig to an elevation where the deck of the jack-up rig is substantially at the same elevation with the upper surface of the bridge;

i. connecting the end portion of the bridge nearest the substructure to the jack-up rig; and j. sliding the substructure and drilling apparatus thereon from the jack-up rig across the bridge onto the skid mat.

9. The method of placing an oil or gas drilling apparatus on a fixed offshore platform comprising the steps of:

a. providing a jack-up rig including a structure which comprises:

i. a skid mat;

ii. a structural bridge connectable at one end portion to said jack-up rig and at the other end portion to said substructure;

b. placing the drilling apparatus on the jack-up rig;

c. elevating the surface of the jack-up rig to an elevation substantially equal the elevation of the surface of the fixed platform;

d. connecting the structural bridge at one end portion to the jack-up rig and at the other end portion to the fixed platform; and e. transferring the drilling apparatus across the bridge from the jack-up rig to the fixed platform.

10. The method of claim 9 further comprising the step between steps "*b*" and "*c*" of supporting the jack-up rig firmly on the water bottom.

11. The method of claim 9 in which a movable substructure is provided in step "*a*" for supporting the drilling apparatus, and in step "*e*" the drilling apparatus is transferred from the jack-up rig to the fixed platform by sliding the substructure and the supported drilling apparatus from the jack-up rig across the bridge to the fixed platform.

12. The method of claim 11, further comprising the steps between steps "*c*" and "*d*" of:

-connecting the structural bridge at one end portion to the substructure and at its other end portion to the skid mat;

-sliding the skid mat and bridge from the jack-up rig to the fixed platform a distance which aligns the end portion of the bridge connected to the substructure with the edge of the jack-up rig nearest the fixed platform; and -the connection between the substructure and the bridge.

* * * * *